US007049254B2

(12) United States Patent
Bansal et al.

(10) Patent No.: US 7,049,254 B2
(45) Date of Patent: May 23, 2006

(54) MULTIPLE COMPONENT MELTBLOWN WEBS

(75) Inventors: Vishal Bansal, Richmond, VA (US); Sam Louis Samuels, Landenberg, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 279 days.

(21) Appl. No.: 10/293,736

(22) Filed: Nov. 13, 2002

(65) Prior Publication Data

US 2004/0092191 A1 May 13, 2004

(51) Int. Cl.

| | |
|---|---|
| ***D04H 1/00*** | (2006.01) |
| ***D04H 1/56*** | (2006.01) |
| ***B32B 5/26*** | (2006.01) |

(52) U.S. Cl. ..... 442/347; 442/340; 442/346; 442/362; 442/382; 442/389; 442/400; 428/903

(58) Field of Classification Search ..... 442/340, 442/347, 362, 364, 382, 389, 400; 428/903
See application file for complete search history.

(56) References Cited

U.S. PATENT DOCUMENTS

| | | | | |
|---|---|---|---|---|
| 4,681,801 | A * | 7/1987 | Eian et al. | 442/361 |
| 5,409,765 | A | 4/1995 | Boettcher et al. | |
| 5,503,907 | A | 4/1996 | Gessner et al. | |
| 5,534,335 | A | 7/1996 | Everhart et al. | |
| 5,643,662 | A | 7/1997 | Yeo et al. | |
| 5,817,415 | A | 10/1998 | Chou et al. | |
| 6,465,094 | B1 * | 10/2002 | Dugan | 428/370 |
| 2002/0037679 | A1 * | 3/2002 | Bansal et al. | 442/415 |

FOREIGN PATENT DOCUMENTS

| | | |
|---|---|---|
| EP | 0 351 318 A2 | 1/1990 |
| KR | 1991-0004459 B1 | 6/1991 |
| WO | WO 02/10497 A1 | 2/2002 |

OTHER PUBLICATIONS

Alger, Mark. Polymer Science Dictionary: Second Edition. Chapman & Hall, London, UK. 1989. p. 268.*

* cited by examiner

*Primary Examiner*—Jenna-Leigh Befumo

(57) ABSTRACT

Multiple component meltblown webs are disclosed in which the meltblown fibers include an ionomer on at least a portion of the peripheral surface thereof. The meltblown webs are especially useful in dust wipe applications.

24 Claims, No Drawings

MULTIPLE COMPONENT MELTBLOWN WEBS

BACKGROUND OF THE INVENTION

1. Field of the Invention

This invention relates to multiple component meltblown webs that comprise an ionomeric polymer component. The multiple component meltblown webs are especially suited for use in dust wipes.

2. Description of Related Art

Single component meltblown ionomer microfibers and webs made therefrom are known in the art. For example, Chou et al., U.S. Pat. No. 5,817,415, incorporated herein by reference, describes preparation of microfiber meltblown webs from ethylene/carboxylic acid ionomers for filter applications. Allan et al., European Patent Application Publication No. EP 351318 describes meltblowing polymeric dispersions of incompatible thermoplastic resins which may include ionomers. The meltblown webs are suitable for use as wipes, napkins, and personal care items. Boettcher et al., U.S. Pat. No. 5,409,765 discloses nonwoven webs comprising fibers formed by extruding ionomeric resins that are not blended with polyolefins, monomers, or solvents as well as nonwovens formed by extruding mixtures of an ionomer with a compatible copolymer or terpolymer. The nonwoven webs can be formed using a meltblowing process and can be used to provide a less expensive alternative to superabsorbent powders.

There is a continued need for lower cost nonwoven materials suitable for use as dust wipes which have a high level of dust pick-up as well as other end uses.

BRIEF SUMMARY OF THE INVENTION

In one embodiment, the present invention is directed to a meltblown web comprising multiple component meltblown fibers which comprise a first polymeric component comprising an ionomer and a second polymeric component, wherein the first and second polymeric components comprise distinct zones which extend substantially continuously along the length of the fibers, and wherein at least a portion of the peripheral surface of the multiple component fibers comprises the first polymeric component.

DETAILED DESCRIPTION OF THE INVENTION

The present invention is directed toward meltblown webs which comprise multiple component meltblown fibers comprising an ionomer on at least a portion of the peripheral surface thereof.

The term "ionomer" as used herein refers to salts of ethylene copolymers that include a plurality of comonomers derived from an ethylenically unsaturated carboxylic acid or anhydride precursor of an ethylenically unsaturated carboxylic acid. At least a portion of the carboxylic acid groups or acid anhydride groups are neutralized to form salts of univalent or multivalent metal cations. The term "copolymer" as used herein includes random, block, alternating, and graft copolymers prepared by polymerizing two or more comonomers and thus includes dipolymers, terpolymers, etc.

The term "polyolefin" as used herein, is intended to mean homopolymers, copolymers, and blends of polymers prepared from at least 50 weight percent of an unsaturated hydrocarbon monomer. Examples of polyolefins include polyethylene, polypropylene, poly(4-methylpentene-1), polystyrene, and copolymers thereof.

The term "polyethylene" (PE) as used herein is intended to encompass not only homopolymers of ethylene, but also copolymers wherein at least 85% of the recurring units are ethylene units.

The term "polypropylene" (PP) as used herein is intended to embrace not only homopolymers of propylene but also copolymers where at least 85% of the recurring units are propylene units.

The term "linear low density polyethylene" (LLDPE) as used herein refers to linear ethylene/α-olefin co-polymers having a density of less than about 0.955 g/cm$^3$, preferably in the range of 0.91 g/cm$^3$ to 0.95 g/cm$^3$, and more preferably in the range of 0.92 g/cm$^3$ to 0.95 g/cm$^3$. Linear low density polyethylenes are prepared by co-polymerizing ethylene with minor amounts of an alpha, beta-ethylenically unsaturated alkene co-monomer (α-olefin), the α-olefin co-monomer having from 3 to 12 carbons per α-olefin molecule, and preferably from 4 to 8 carbons per α-olefin molecule. Alpha-olefins which can be co-polymerized with ethylene to produce LLDPE's include propylene, 1-butene, 1-pentene, 1-hexene, 1-octene, 1-decene, or a mixture thereof. Preferably, the α-olefin is 1-hexene or 1-octene.

The term "high density polyethylene" (HDPE) as used herein refers to polyethylene homopolymer having a density of at least about 0.94 g/cm$^3$, and preferably in the range of about 0.94 g/cm$^3$ to about 0.965 g/cm$^3$.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. An example of a polyester is poly (ethylene terephthalate) (PET) which is a condensation product of ethylene glycol and terephthalic acid.

The term "nonwoven fabric, sheet or web" as used herein means a structure of individual fibers, filaments, or threads that are positioned in a random manner to form a planar material without an identifiable pattern, as opposed to a knitted or woven fabric. Examples of nonwoven fabrics include meltblown webs, spunbond continuous filament webs, carded webs, air-laid webs, and wet-laid webs.

The term "meltblown fibers" as used herein, means fibers which are formed by meltblowing, which comprises extruding a melt-processable polymer through a plurality of capillaries as molten streams into a high velocity gas (e.g. air) stream. The high velocity gas stream attenuates the streams of molten thermoplastic polymer material to reduce their diameter and form meltblown fibers having a diameter between about 0.5 and 10 micrometers. Meltblown fibers are generally discontinuous fibers but can also be continuous. Meltblown fibers carried by the high velocity gas stream are generally deposited on a collecting surface to form a meltblown web of randomly dispersed fibers.

The term "spunbond" filaments as used herein means filaments which are formed by extruding molten thermoplastic polymer material as filaments from a plurality of fine, usually circular, capillaries of a spinneret with the diameter of the extruded filaments then being rapidly reduced by drawing and then quenching the filaments. Other filament cross-sectional shapes such as oval, multi-lobal, etc. can also be used. Spunbond filaments are generally continuous and have an average diameter of greater than about 5 micrometers. Spunbond nonwoven fabrics or webs are formed by laying spunbond filaments randomly on a collecting surface such as a foraminous screen or belt. Spunbond webs are generally bonded by methods known in the art such as by hot-roll calendering or by passing the web through a saturated-steam chamber at an elevated pressure. For example, the web can be thermally point bonded at a plurality of thermal bond points located across the spunbond fabric.

The term "multiple component fiber" as used herein refers to any fiber that is composed of at least two distinct polymeric components which have been spun together to form a single fiber. The term "fiber" as used herein refers to both discontinuous and continuous fibers. The at least two polymeric components are preferably arranged in distinct substantially constantly positioned zones across the cross-section of the multiple component fibers and extend substantially continuously along the length of the fibers. Preferably the multiple component fibers are bicomponent fibers which are made from two distinct polymers. Multiple component fibers are distinguished from fibers that are extruded from a single homogeneous or heterogeneous blend of polymeric materials. However, one or more of the distinct polymeric components used to form the multiple component fibers may comprise a blend of polymeric materials. The term "multiple component web" as used herein refers to a nonwoven web comprising multiple component fibers. The term "bicomponent web" as used herein refers to a nonwoven web comprising bicomponent fibers.

The meltblown webs of the current invention comprise multiple component meltblown fibers formed from a first polymeric component which comprises one or more ionomers and a second polymeric component. At least a portion of the peripheral surface of the multiple component meltblown fibers comprises the first polymeric component. For example, the two polymeric components can be spun in a side-by-side configuration, or in a sheath-core configuration wherein the first polymeric component forms the sheath. In a preferred embodiment, the multiple component meltblown web comprises side-by-side bicomponent meltblown fibers. The multiple component meltblown webs can be prepared using methods known in the art. For example, a bicomponent meltblown web can be prepared by separately melt-extruding first and second polymeric components and either contacting the two polymeric components in a bicomponent meltblowing die prior to exiting the die (pre-coalescence method), or contacting the two polymeric components after they have exited the meltblowing die (post-coalescence method). For example, Krueger et al. U.S. Pat. No. 6,057,256, which is hereby incorporated by reference, describes a pre-coalescence bicomponent meltblowing process.

Ionomers suitable as the first polymeric component in the multiple component meltblown webs of the current inventions include metal ion neutralized copolymers of ethylene with acrylic acid, methacrylic acid, or a combination thereof. The ionomer preferably contains 5 to 25 weight percent, preferably 8 to 20 weight percent, and most preferably 8 to 15 weight percent of acrylic acid, methacrylic acid, or a combination thereof. Preferably between about 5 to 70 percent, more preferably between about 25 to 60 percent of the acid groups are neutralized with metal ions. Suitable metal ions include sodium, zinc, lithium, magnesium, and combinations thereof. Optionally, the ionomer can be a terpolymer in which a third monomer, comprising an alkyl acrylate wherein the alkyl group has between 1 and 8 carbons, is co-polymerized with the ethylene and acrylic acid (or methacrylic acid or combination thereof with acrylic acid). This is referred to as a "softening" monomer and can be present up to about 40 weight percent based on total monomer. Ionomers suitable for use in the current invention are available commercially from a number of sources and include Surlyn® ionomer resins, available from E.I. du Pont de Nemours and Company (Wilmington, Del.).

The first polymeric component can consist essentially of one or more ionomers or can comprise a blend of one or more ionomers with one or more non-ionomeric polymers. The additional polymer(s) included in the blend preferably form a compatible (miscible) or near-compatible (substantially miscible) blend. For example, Surlyn® ionomers may form near-compatible blends with LLDPE, HDPE, or LDPE. The blends are preferably prepared so as to contain 5 to 25 weight percent of neutralized acid monomer units based on the total weight of the polymer blend. For example, an ionomer which contains 25 weight percent neutralized acid monomer units blended in a 50:50 weight ratio with another polymer provides a blend which contains 12.5 weight percent of neutralized acid monomer units based on total weight of polymer in the blend.

The second polymeric component can be selected to provide the desired cost or other properties such as dust wipe performance, temperature stability, etc. For example, polyolefins, polyesters, and polyamides are suitable for use as the second polymeric component. Specific polymers suitable for use as the second polymeric component include polypropylene, polyethylene, polystyrene, poly (1,3-propylene terephthalate), poly(ethylene terephthalate), poly(hexamethylene adipamide) (nylon 6,6), and polycaprolactam (nylon 6). Suitable polyethylenes include linear low density polyethylene and high density polyethylene. Webs comprising poly (ethylene terephthalate) as the second polymeric component have been found to provide low cost multiple component meltblown webs having excellent dust wipe performance. Alternately, polypropylene may be selected as the second polymeric component to provide a low cost multiple component meltblown fabric.

The multiple component meltblown fibers preferably comprise between about 10 to 90 weight percent of the first polymeric component and between about 90 to 10 weight percent of the second polymeric component. Bicomponent side-by-side meltblown webs in which the first polymeric component comprises an ionomeric copolymer of ethylene and acrylic acid, methacrylic acid or a combination thereof and the second polymeric component comprises PET have been found to perform surprisingly well as dust wipes when the meltblown fibers comprise between about 20 to 30 weight percent ionomer as well as when the meltblown fibers comprise between about 70 to 80 weight percent ionomer. For example when the weight ratio of ionomer: PET in the meltblown fibers was 75:25 and also when it was 25:75, the dust wiping performance of the meltblown web was significantly better than when the weight ratio of ionomer:PET was 50:50.

The meltblown webs of the current invention preferably have a basis weight between about 10 and 100 g/m$^2$ and are suitable for use as dust wipes, particulate filters, and protective clothing. The meltblown webs are especially preferred for use as dust wipes. It is believed that the combination of small fiber size and ionomeric fiber surface provides a fabric with extremely good dust wipe performance. Certain meltblown webs of the current invention have better dust wipe performance than single component meltblown webs made from non-ionomeric polymers such as polypropylene, polyethylene, or poly(ethylene terephthalate).

Multi-layer composite sheet materials may be formed by collecting the multiple component meltblown fibers on a second layer such as another nonwoven web, woven fabric, or knit fabric. Examples of nonwoven webs suitable as the second layer include spunbond, hydroentangled, and needle-punched webs. Alternately, a previously formed multiple component meltblown web can be bonded to such sheet materials or to a polymeric film. The layers may be joined using methods known in the art such as by hydraulic needling or by thermal, ultrasonic, and/or adhesive bonding. When the composite sheet material is used as a dust wipe, the meltblown web preferably forms one or both of the outer surfaces of the composite sheet material. For example, a composite sheet material can be formed by bonding a meltblown web of the current invention to a spunbond web (S-M) or by bonding a meltblown web to both sides of a spunbond web (M-S-M). The multiple component meltblown web and other sheet layer preferably each include polymeric components which are compatible so that the layers can be thermally bonded, such as by thermal point bonding. For example, in one embodiment, a composite sheet is formed comprising a multiple component meltblown web of the current invention and a multiple component spunbond web such as a spunbond web comprising sheath-core or side-by-side fibers. The polymeric components of the spunbond web are preferably selected such that the peripheral surface (e.g. the sheath in sheath-core fibers) of the spunbond fibers comprise a polymer that is compatible with, that is can be thermally bonded to, the ionomeric polymer or to the second polymeric component in the case where the meltblown web comprises side-by-side meltblown fibers. For example, the peripheral surface of the spunbond fibers can comprise a polymer selected from the group consisting of polyolefins, polyamides, and polyesters. Linear low density polyethylene is an example of a polymer that is compatible or near-compatible with ionomers. A compatibilizing agent can be added to one of the polymer to facilitate thermal bonding. An example of a suitable compatibilizing agent is Fusabond® E MB 226D, available from E.I. du Pont de Nemours and Company (Wilmington, Del.). This material can be added at about 5 to 7 weight percent to LLDPE to achieve thermal bonding to PET. Resins in the DuPont Fusabond® product line are modified polymers that have been functionalized, typically by maleic anhydride grafting. Suitable Fusabond® resins include modified ethylene acrylate carbon monoxide terpolymers, ethylene vinyl acetates, polyethylenes, metallocene polyethylenes, ethylene propylene rubbers and polypropylenes.

TEST METHODS

In the description above and in the examples that follow, the following test methods were employed to determine various reported characteristics and properties. ASTM refers to the American Society for Testing and Materials.

Basis Weight is a measure of the mass per unit area of a fabric or sheet and was determined by ASTM D-3776, which is hereby incorporated by reference, and is reported in g/m$^2$.

Dust wipe performance was evaluated using a commercially available Swiffer® mop (distributed by Procter & Gamble, Cincinnati, Ohio). Half the face of the mop was covered with a commercially available Swiffer® dry dust wipe (15.2 cm×15.2 cm). The other half was covered with the sample to be tested, having the same dimensions as the Swiffer® wipe. Fifty swipes of an area of floor in a warehouse qualifying as a light industrial environment were carried out. The Swiffer® wipe and the test sample were weighed before and after the fifty swipes. The dust pick-up was calculated by the difference in weight. A wiping performance factor was defined as the ratio of the weight of dust picked up by a test sample and the weight of dust picked up by the Swiffer® dust wipe.

EXAMPLES

Meltblown bicomponent webs were made with an ionomer component and a polyester component. The ionomer was a copolymer of ethylene and methacrylic acid having a melt index of 280 g/10 min (measured according to ASTM D-1238; 2.16 kg @ 190° C.) and containing 10 weight percent of the carboxylic acid with 25 percent of the acid groups neutralized with magnesium ions. The polyester component was poly(ethylene terephthalate) with a reported intrinsic viscosity of 0.53 dl/g, available from DuPont as Crystar® polyester (Merge 4449). The poly(ethylene terephthalate) had a moisture content of 1500 ppm as it was fed to the extruder. The ionomer was heated to 260° C. and the poly(ethylene terephthalate) was heated to 305° C. in separate extruders and metered as separate polymer streams to a melt-blowing die assembly that was heated to 305° C. The two polymer streams were independently filtered in the die assembly and then combined to provide a side-by-side fiber configuration. The polymers were spun through each capillary at a polymer throughput per hole of 0.8 g/min (30 holes/inch), attenuated with jets of pressurized hot air (5 psig (34.5 kPa), 305° C.) to form meltblown fibers that were collected on a moving forming screen located below the die to form a bicomponent meltblown web. The die-to-collector distance was 12.7 cm. The percentage of ionomer and poly(ethylene terephthalate) were varied for different samples by changing the ratio of polymer throughput for the two polymers. Sheets were collected at ratios of 75%, 50%, and 25% by weight poly(ethylene terephthalate). For each polymer ratio, samples with basis weights of 12 g/m$^2$ and 36 g/m$^2$ were collected. The samples were tested for dust wipe performance as described above. Control samples that were also tested were: Example A: bicomponent poly(ethylene terephthalate) meltblown web with fibers formed from 80 weight percent poly(ethylene terephthalate) (intrinsic viscosity 0.53 dl/g Crystar® 4449 available from DuPont) and 20 weight percent linear low density polyethylene (melt index 135 g/10 min, available from Equistar Chemicals as GA 594); Example B: single component meltblown web with fibers formed from polypropylene (melt flow rate 1200 g/10 min, available from Exxon Chemicals as 3546G); Example C: single component meltblown web with fibers formed from Crystar® 4449 poly(ethylene terephthalate), and Example D: single component meltblown web with fibers formed from Equistar GA594 linear low density polyethylene. Wiping performance factors are reported in Table 1 below:

TABLE 1

Wiping Performance Factors for Meltblown Webs

| EX | Description of Meltblown Web | Basis weight (g/m$^2$) | Wiping Performance Factor |
|---|---|---|---|
| 1 | 75 wt % PET/25 wt % ionomer | 12 | 1.16 |
| 2 | 50 wt % PET/50 wt % ionomer | 12 | 0.22 |

TABLE 1-continued

Wiping Performance Factors for Meltblown Webs

| EX | Description of Meltblown Web | Basis weight ($g/m^2$) | Wiping Performance Factor |
|---|---|---|---|
| 3 | 25 wt % PET/75 wt % ionomer | 12 | 0.81 |
| 4 | 75 wt % PET/25 wt % ionomer | 36 | 1.43 |
| A | 80 wt % PET/25 wt % LLDPE | 17 | 0.51 |
| B | 100% PP | 17 | 0.36 |
| C | 100% PET | 17 | 0.61 |
| D | 100% LLDPE | 17 | 0.52 |

The results demonstrate that meltblown webs made from side-by-side fibers containing 75 wt % PET and 25 wt % ionomer appear to offer significant improvement in dust wipe performance over commercially available Swiffer® dust wipes. Comparing the results of Example 4 to those of Example 1, it appears that higher basis weights result in improved dust wipe performance. The above results also suggest that the ratio between the two polymers may play a role in determining wipe performance. For example, when either the PET or the Surlyn® component was the major component, as in Examples 1, 3, and 4, significant improvement was seen compared to Example 2 in which the PET and Surlyn® were present at equal weight percent. Examples 1, 3, and 4 also showed significant improvement in dust wipe performance compared to comparative Examples A–D. The comparative examples did not come close to matching the performance of the inventive wipes.

What is claimed is:

1. A meltblown web comprising bicomponent meltblown fibers having diameters between about 0.5 and 10 micrometers, which comprise first and second polymeric components arranged in a side-by-side configuration, said a first polymeric component consisting of an ionomer.

2. The meltblown web according to claim 1 wherein the ionomer is a metal ion neutralized copolymer of ethylene with an ethylenically unsaturated carboxylic acid or an anhydride precursor thereof selected from the group consisting of acrylic acid, methacrylie acid, and combinations thereof.

3. The meltblown web according to claim 1 wherein the second polymeric component is selected from the group consisting of polyesters, polyamides, and polyolefins.

4. The meltblown web according to claim 3 wherein the second polymeric component comprises a polyester.

5. The meltblown web according to claim 2 wherein the ethylenically unsaturated carboxylic acid comprises between about 5 to about 25 weight percent of the ionomer.

6. The meltblown web according to claim 5 wherein between about 5 to 70% of the carboxylic acid groups are neutralized with metal ions.

7. The meltblown web according to claim 6 wherein the metal ions are selected from the group consisting of sodium, zinc, lithium, magnesium, and combinations thereof.

8. The meltblown web according to claim 3 wherein the second polymeric component is poly(ethylene terephthalate).

9. The meltblown web according to claim 8 wherein the bicomponent fibers comprise between about 10 to 90 weight percent poly(ethylene terephthalate) and between 90 to 10 weight percent of the first polymeric component.

10. The meltblown web according to claim 9 wherein the bicomponent fibers comprise between about 70 to 80 weight percent poly(ethylene terephthalate) and between about 20 to 30 weight percent of the first polymeric component.

11. The meltblown web according to claim 9 wherein the bicomponent fibers comprise between about 70 to 80 weight percent of the first polymeric component and between about 20 to 30 weight percent poly(ethylene terephthalate).

12. The meltblown web according to any of claims 1, 11 or 10, wherein the fibers comprise about 25 weight percent of the first polymeric component.

13. A multi-layer composite sheet comprising a first layer and a second layer, wherein the first layer is the meltblown web of claim 1, and the meltblown web comprises an outer surface of the composite sheet.

14. The composite sheet according to claim 13 wherein the second layer is selected from the group consisting of nonwoven webs, films, woven fabrics, and knit fabrics.

15. The composite sheet according to claim 14 wherein the second layer is a spunbond nonwoven web.

16. The composite sheet according to claim 15 wherein the spunbond web is a multiple component spunbond web.

17. The composite sheet according to claim 16 wherein the multiple component spunbond web comprises sheath-core spunbond fibers.

18. The composite sheet according to claim 17 wherein the sheath comprises a polymer selected from the group consisting of polyolefins, polyamides, and polyesters.

19. The composite sheet according to claim 18 wherein the sheath comprises polyethylene.

20. A particulate filter comprising the meltblown web of claim 1.

21. The meltblown web according to any of claims 1, 9 or 11, wherein the fibers comprise about 75 weight percent of the first polymeric component.

22. A wipe comprising the meltblown web of any of claim 1.

23. A wipe comprising the meltblown web of claim 13.

24. A wipe comprising the meltblown web of claim 21.

* * * * *

UNITED STATES PATENT AND TRADEMARK OFFICE

CERTIFICATE OF CORRECTION

PATENT NO. : 7,049,254 B2
APPLICATION NO. : 10/293736
DATED : May 23, 2006
INVENTOR(S) : Vishal Bansal and Sam Louis Samuels It is certified that error appears in the above-identified patent and that said Letters Patent is hereby corrected as shown below:

Column 7
Line 39, after "said" remove "a"

Column 8
Line 22, after "claims 1," remove "11"
Line 22, after "claims 1," insert -- 9 --

Signed and Sealed this

Twenty-seventh Day of March, 2007

JON W. DUDAS
*Director of the United States Patent and Trademark Office*